US008141466B2

(12) United States Patent
Peters

(10) Patent No.: US 8,141,466 B2
(45) Date of Patent: Mar. 27, 2012

(54) PUNCH DEVICE FOR PIERCING HYDRO-FORMED MEMBER

(75) Inventor: Chris E. Peters, Guelph (CA)

(73) Assignee: Magna International Inc., Aurora (CA)

( * ) Notice: Subject to any disclaimer, the term of this patent is extended or adjusted under 35 U.S.C. 154(b) by 322 days.

(21) Appl. No.: 12/512,393

(22) Filed: Jul. 30, 2009

(65) Prior Publication Data

US 2010/0031797 A1 Feb. 11, 2010

Related U.S. Application Data

(60) Provisional application No. 61/086,492, filed on Aug. 6, 2008.

(51) Int. Cl.
*B26F 1/14* (2006.01)

(52) U.S. Cl. ..... 83/684; 85/30; 85/54; 85/692; 72/55; 29/421.1

(58) Field of Classification Search ..... 83/122, 83/24, 30, 53, 54, 681–685, 692, 917; 29/421.1; 30/358, 360, 362; 72/54–56, 370.27, 324–327, 72/330, 429, 462

See application file for complete search history.

(56) References Cited

U.S. PATENT DOCUMENTS

| | | | | |
|---|---|---|---|---|
| 1,761,207 | A * | 6/1930 | Guertin | 30/358 |
| 2,433,058 | A * | 12/1947 | Mesaros | 408/68 |
| 3,074,165 | A * | 1/1963 | Davis | 30/358 |
| 6,502,491 | B2 * | 1/2003 | Borowczak et al. | 83/358 |
| 2006/0065030 | A1 * | 3/2006 | Ghiran et al. | 72/55 |
| 2008/0190163 | A1 * | 8/2008 | Ghiran et al. | 72/55 |

* cited by examiner

*Primary Examiner* — Phong Nguyen

(57) ABSTRACT

A piercing device for hydro-formed members comprises a punch having a cutting surface and a guide bore, a support member having a guide post complementary in shape to the guide bore and drive passages, and a drive member having two arms forming U-shaped members. The arms of the drive member extend through the drive passages of the support member to transfer a force between a ram and the punch.

4 Claims, 6 Drawing Sheets

PUNCH DEVICE FOR PIERCING HYDRO-FORMED MEMBER

CROSS-REFERENCE TO RELATED APPLICATIONS

This application claims the benefit of U.S. Provisional Application No. 61/086,492, filed on Aug. 6, 2008, entitled "Punch Device For Piercing Hydro-Formed Member", the disclosure of which is incorporated herein by reference for all purposes.

FIELD OF THE INVENTION

The present invention relates to a device and method for forming apertures in a hollow member. More specifically, the present invention relates to a device and method for piercing a hydro-formed member to create an aperture therein.

BACKGROUND OF THE INVENTION

Hydro-forming of steel and other metal hollow members is becoming increasingly common. With hydro-forming the cost of manufacture of hollow members can be reduced, in comparison to conventional stamping, welding and other manufacturing techniques. Further, the quality (strength, tolerances, etc.) of the finished hydro-formed member can exceed the quality of members formed with conventional techniques.

After a member has been hydro-formed, it typically requires a series of additional manufacturing operations and/or forming steps. One common post-forming operation is the need to form one or more apertures in the member and much effort has previously been devoted to forming these apertures in the member via piercing when the formed member is still in the hydro-forming die.

While piercing is now commonly used to form desired apertures in hydro-formed members, difficulties still exist with piercing technologies. In particular, the size of the cylinders required to perform the pierce can restrict the number of apertures that can be formed in any region of the member, as insufficient volume may be available to accommodate the cylinders in the region of interest. Further, the quality (shape and/or clean cut of the edges) of the aperture may not be as good as desired.

To address these issues, piercing systems which employ a negative pierce have been proposed. In the proposed negative pierce system, the piercing punch is retracted during a portion of the hydro-forming cycle such that the portion of the formed member to be pierced is extruded outward from the formed member. The piercing punch is then extended into the extruded portion to pierce the resulting weakened area and form the desired aperture. By first extruding the portion to be pierced, the force required to perform the pierce is reduced, allowing for a smaller cylinder to be employed for a given sized aperture and allowing for a better quality aperture to be obtained.

While the proposed negative pierce operations provide advantages, the additional complexity and expense required to operate the hydraulic cylinder to first retract and then extend the piercing die increases the expense of the hydro-forming set up. Further, the extra complexity (hydraulic lines, stops, etc.) can occupy more volume in the hydro-forming die, thus limiting the number of apertures and/or spacing of those apertures that can be formed in a given area of the hydro-formed member.

It is desired to have a piercing device and method which provides for negative piercing while avoiding the need for complex and/or bulky hydraulic control systems.

SUMMARY OF THE INVENTION

It is an object of the present invention to provide a novel piercing device and method which obviates or mitigates at least one disadvantage of the prior art.

According to a first aspect of the present invention, there is provided a piercing device for forming apertures in hollow members, comprising: a punch having a cutting surface to pierce the hollow member and a guide bore extending through the punch; a support member including a guide post complementary in shape to the guide bore, the punch being slidably received on the guide post; and a drive member operable to transfer a force between a ram and the punch, the drive member extending through the support member.

The present invention provides a piercing device and method which can be used to form apertures in formed members. In particular, it is believed that the present invention is particularly suited for forming apertures in hydro-formed members. The piercing device of the present invention advantageously occupies relatively little volume, allowing multiple piercing devices to be located within relatively small volumes about a hydro-forming die, or the like. The device and method can be used to perform complete pierces, wherein the slug is removed from the formed member, or to perform partial pierces, wherein the slug is maintained captive in place until removed by a subsequent manufacturing operation. The present invention also provides for a negative pierce to be achieved, during the hydro-forming process, prior to the pierce operation being performed. This negative pierce results in a reduction in the force required to perform the pierce operation and thus permits the use of a smaller hydraulic ram, or the like. In turn, this can result in a cost saving and can result in even denser mounting of adjacent piercing devices within a hydro-forming die or the like.

This and other objects of the invention can be more fully appreciated from the following detailed description of the preferred embodiments.

BRIEF DESCRIPTION OF THE DRAWINGS

Exemplary embodiments of the invention will now be described in conjunction with the following drawings wherein like numerals represent like elements, and wherein.

DETAILED DESCRIPTION OF THE PREFERRED EMBODIMENTS

Figure 1:
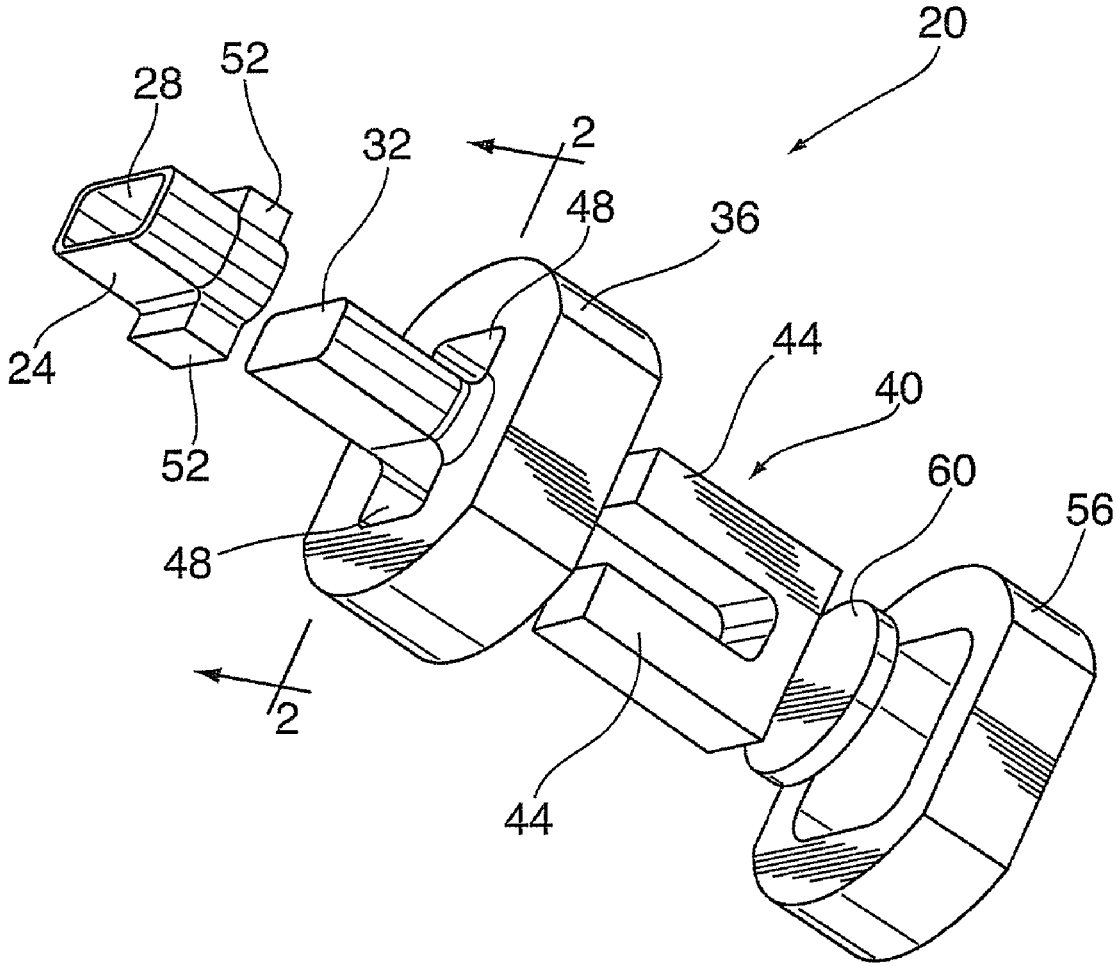
FIG. 1 shows an exploded perspective view of a first embodiment of a piercing device in accordance with the present invention.
Figure 2:
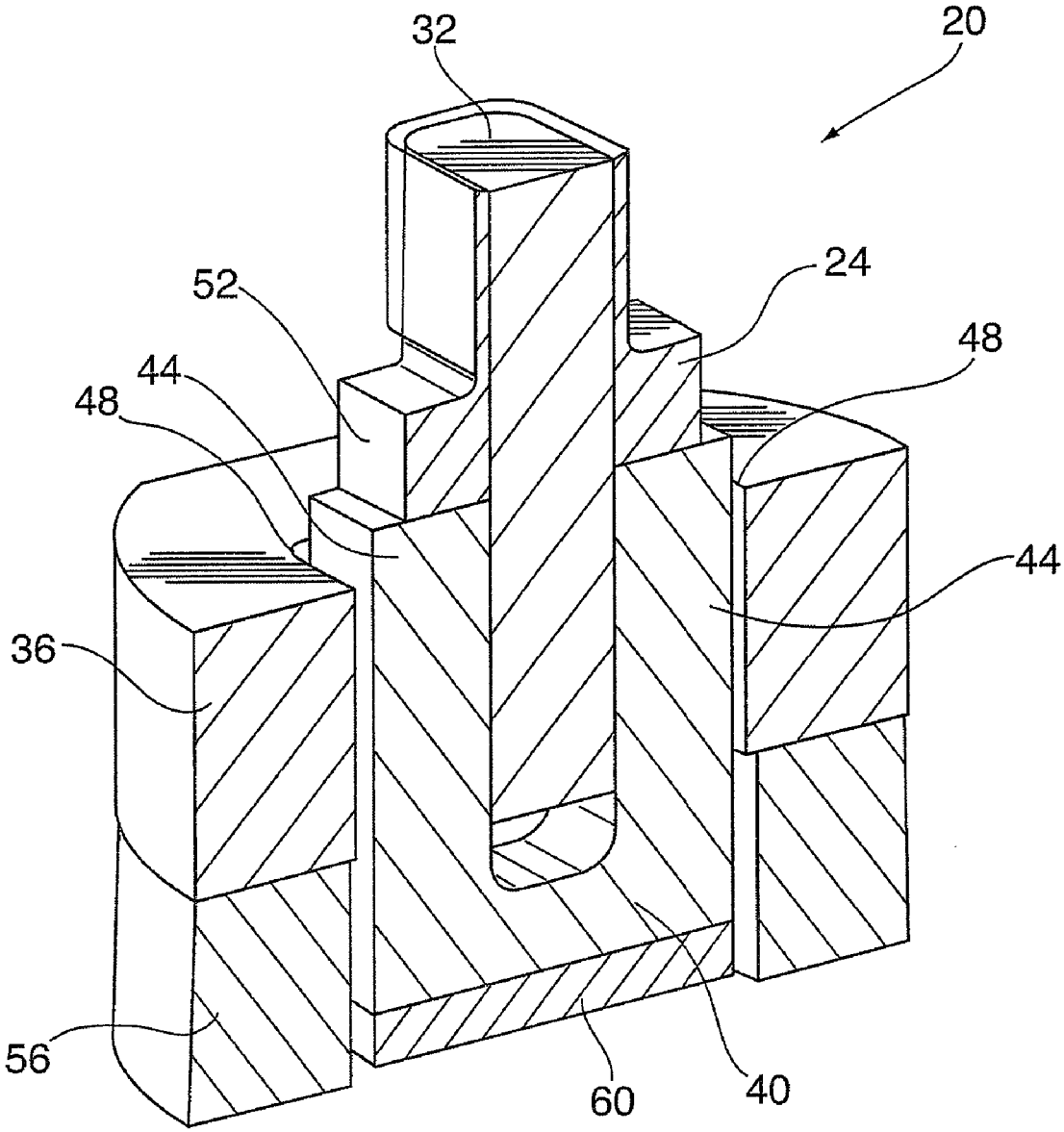
FIG. 2 shows a cross section view taken through line 2-2 of FIG. 1.

A piercing device, useful for forming apertures in hydro-formed members and other needs, is indicated generally at 20 in FIGS. 1 and 2. Device 20 includes a punch 24 which includes a central guide bore 28 which is complementary in shape to a guide post 32 which is part of a support member 36. Support member 36 can be appropriately mounted in a hydro-forming die, or the like, to position punch 24 as desired with respect to a member to be pierced.

Device 20 further comprises a drive member 40, which in the illustrated embodiment, is generally U-shaped. In this embodiment, the arms 44 of drive member 40 extend through drive passages 48 in support member 36 to abut drive surfaces 52 on punch 24. As should now be apparent, movement of drive member 40 into or out of support member 36 results in punch 24 being moved along guide post 32.

Device 20 further includes a mounting member 56 which can be attached to the body of a hydraulic ram (not shown), or the like, to allow the ram to apply force to drive member 40 as needed. A backing plate 60 can also be provided to assist in the distribution and transfer of force between the ram and drive member 40.

Figure 3A:
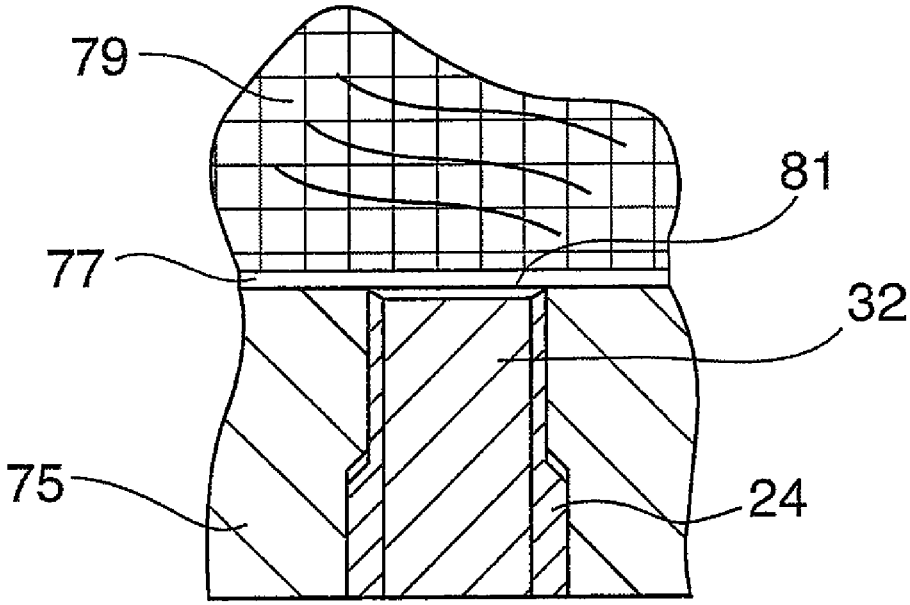
FIGS. 3*a* through 3*d* show a cross section through a portion of the piercing device of FIG. 1 installed in a hydro-forming die for a first method of forming an aperture.

FIGS. 3*a* through 3*d* illustrate one method of employing device 20. In FIG. 3*a*, wherein only punch 24 and guide post 32 are shown for simplicity, device 20 has been installed in a hydro-forming die 75. Die 75 has been loaded with a member 77 to be hydro-formed and member 77 has been filled with water 79 which is at a low pressure.

As can be seen in FIG. 3*a*, punch 24 is positioned in a retracted position wherein its cutting edge is flush with the surface of member 77. However, as can also be seen, guide post 32 is positioned such that a small gap 81 is present between member 77 and the end surface of guide post 32.

Figure 3B:
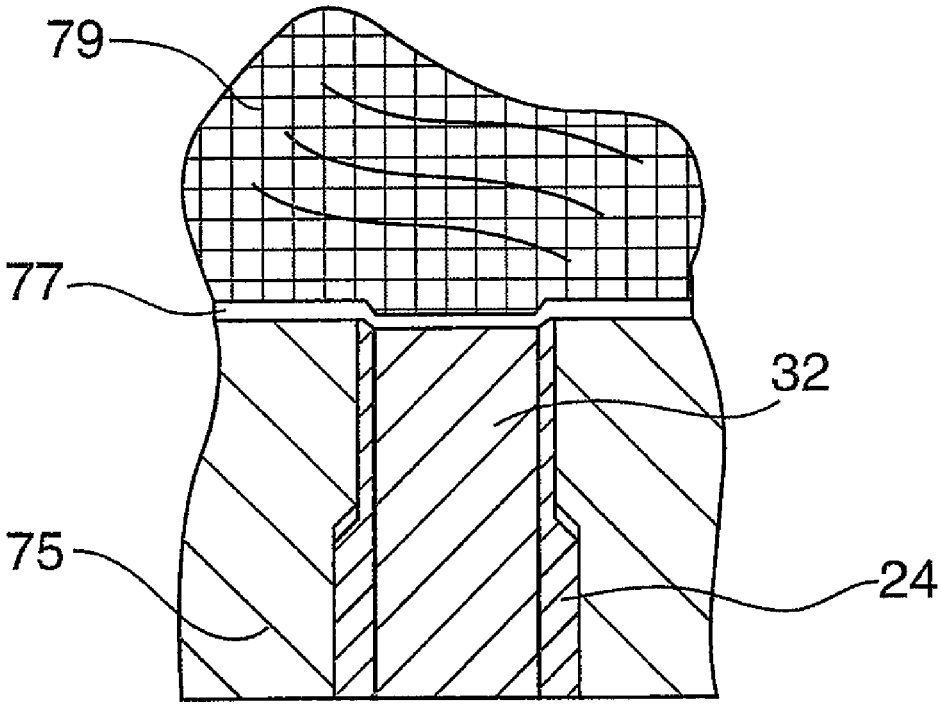

In FIG. 3*b*, water 79 has been pressurized to perform the hydro-forming of member 77. As can be seen, a portion of member 77 has been extruded by the hydro-forming to fill gap 81, effectively providing a negative pierce of member 77 in this region.

By forming a negative pierce prior to the pierce operation being performed, a reduction in the force required to perform the pierce operation is achieved, thus permitting the use of a smaller hydraulic ram, or the like.

Figure 3C:
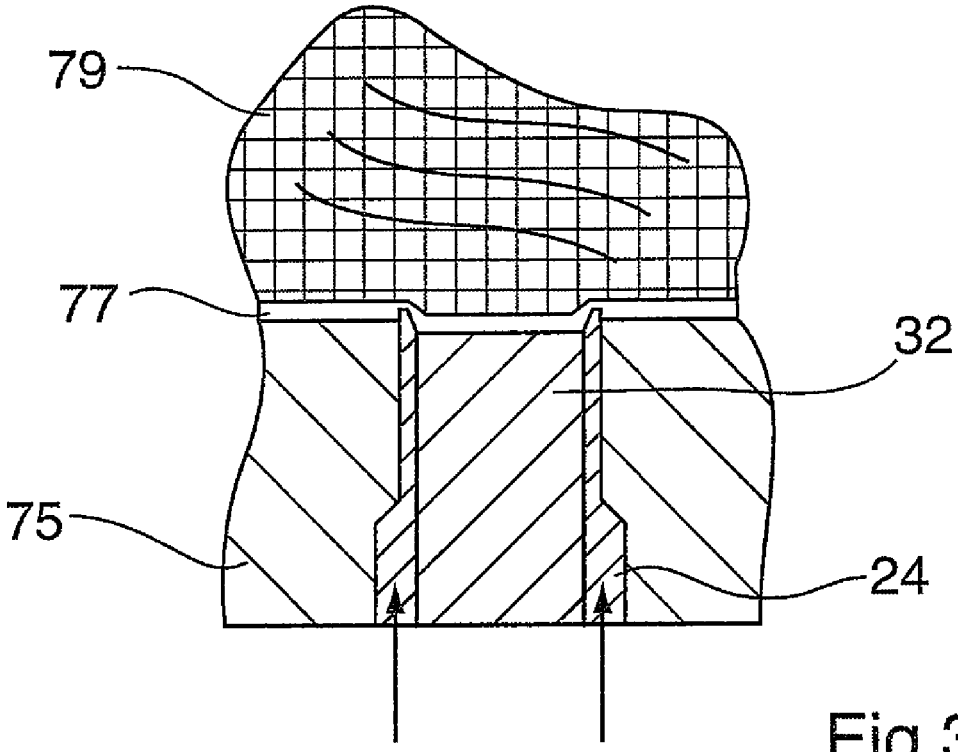
Figure 3D:
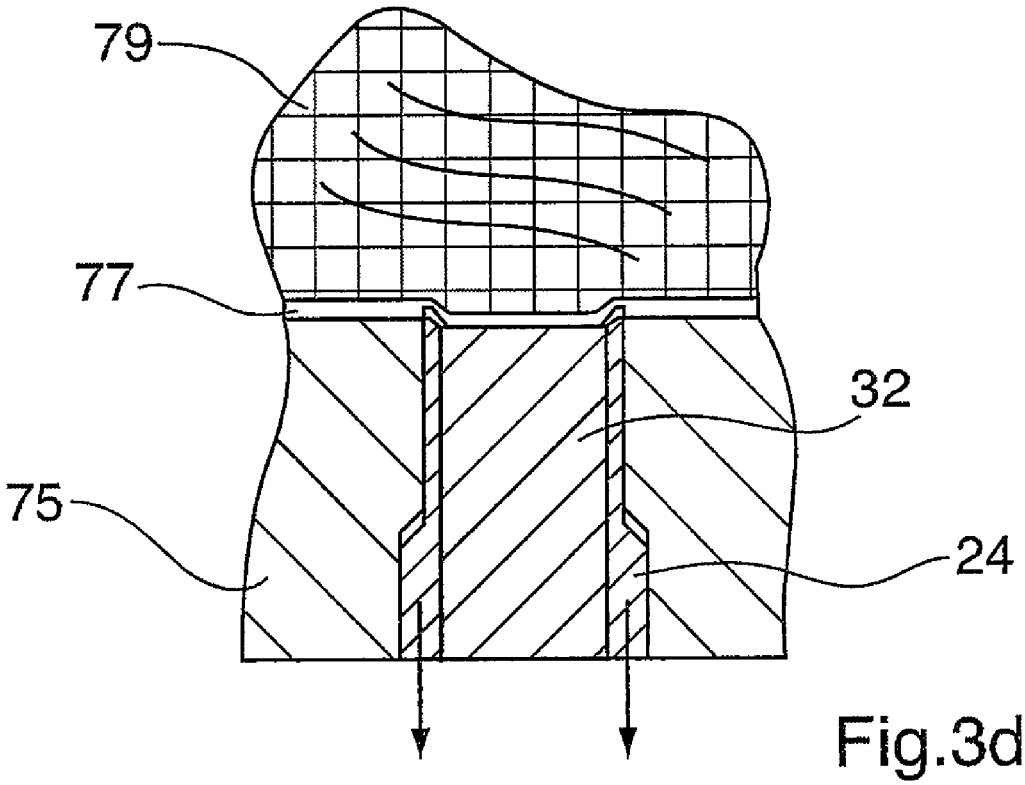

In FIG. 3*c*, punch 24 is advanced into member 77 while water 79 is pressurized to perform the pierce. In FIG. 3*d*, once the pierce has been achieved, punch 24 is retracted and water 79 is de-pressurized.

In the method illustrated in FIGS. 3*a* through 3*d*, only a partial pierce is being performed wherein the material to be removed, typically referred to as the "slug", to form the desired aperture remains captive in member 77 and is removed in a subsequent processing step to avoid having a loose slug remain inside member 77 or in hydro-forming die 75.

A partial pierce can be achieved by carefully controlling the distance to which punch 24 is inserted into member 77 and/or by the design of the cutting surfaces of punch 24.

In the latter case, the cutting surfaces of punch 24 can include one or more regions which are recessed, relative to the other regions of the cutting surfaces, such that the recessed cutting regions do not completely pierce member 77, but do form a weakened area, such that the slug remains captive in place until removed by severing the weakened area(s) in a subsequent manufacturing step. The subsequent removal of the slug can be simply accomplished by pressing against the captive slug with a drift or punch.

Figure 4A:
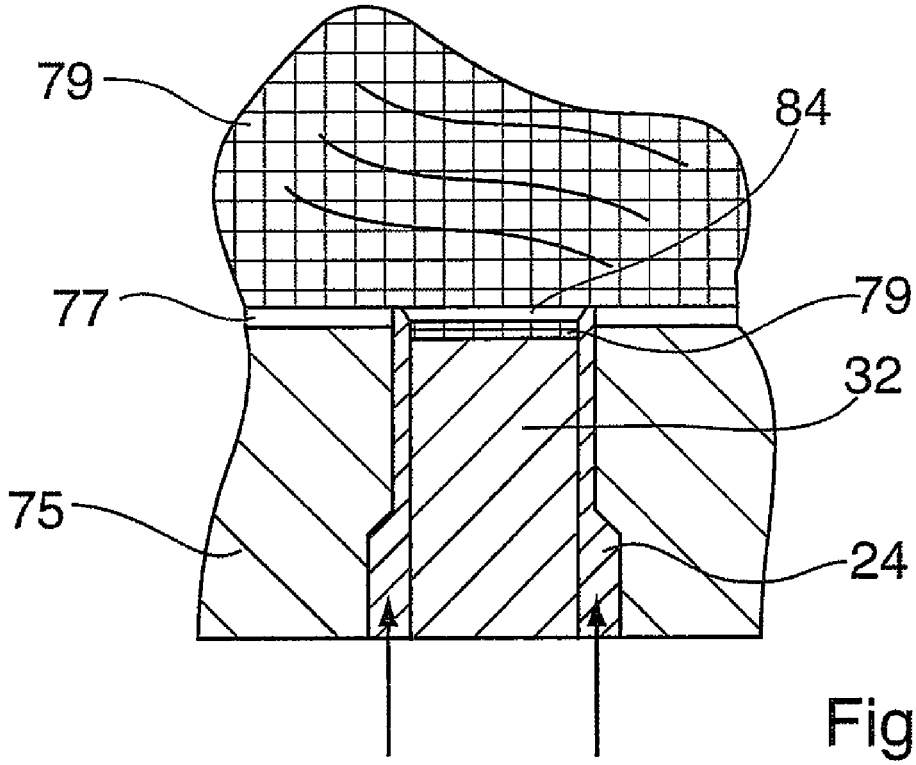
FIGS. 4*a* and 4*b* show a cross section through a portion of the piercing device of FIG. 1 installed in a hydro-forming die for a second method of forming an aperture.
Figure 4B:
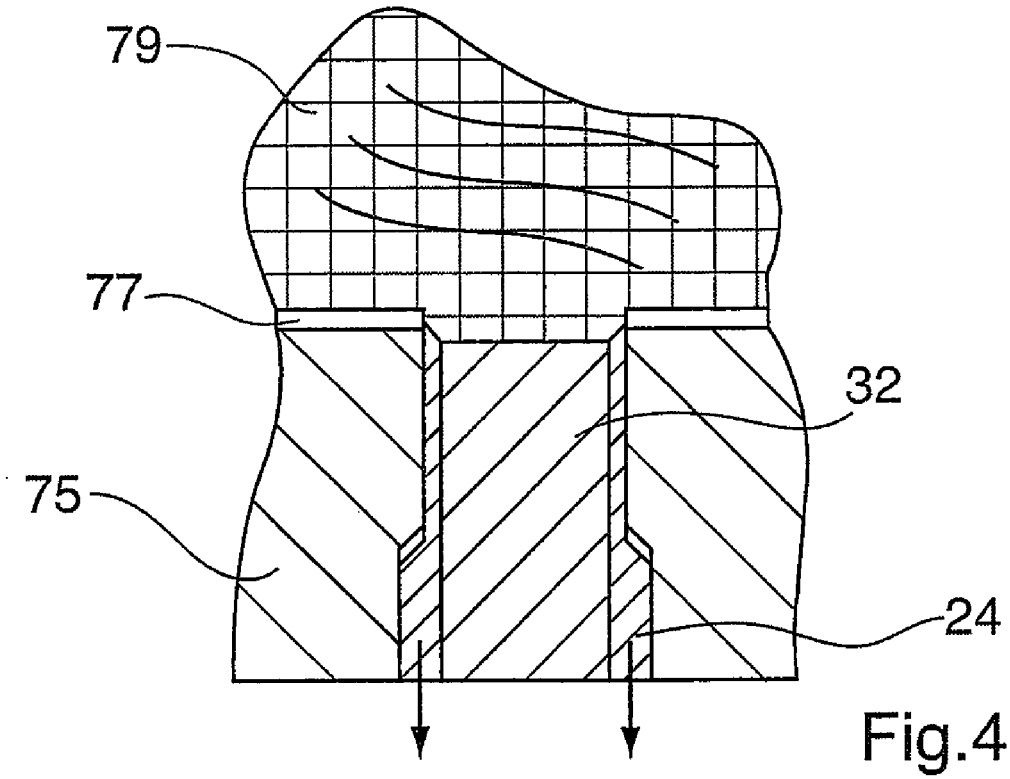

However, the present invention is not limited to performing partial piercings. FIGS. 4*a* and 4*b* show the equivalent method steps to those of FIGS. 3*c* and 3*d* respectively, as described above, wherein a complete pierce is performed and the resulting free slug 84 is pushed into the interior of member 77.

Figure 5:
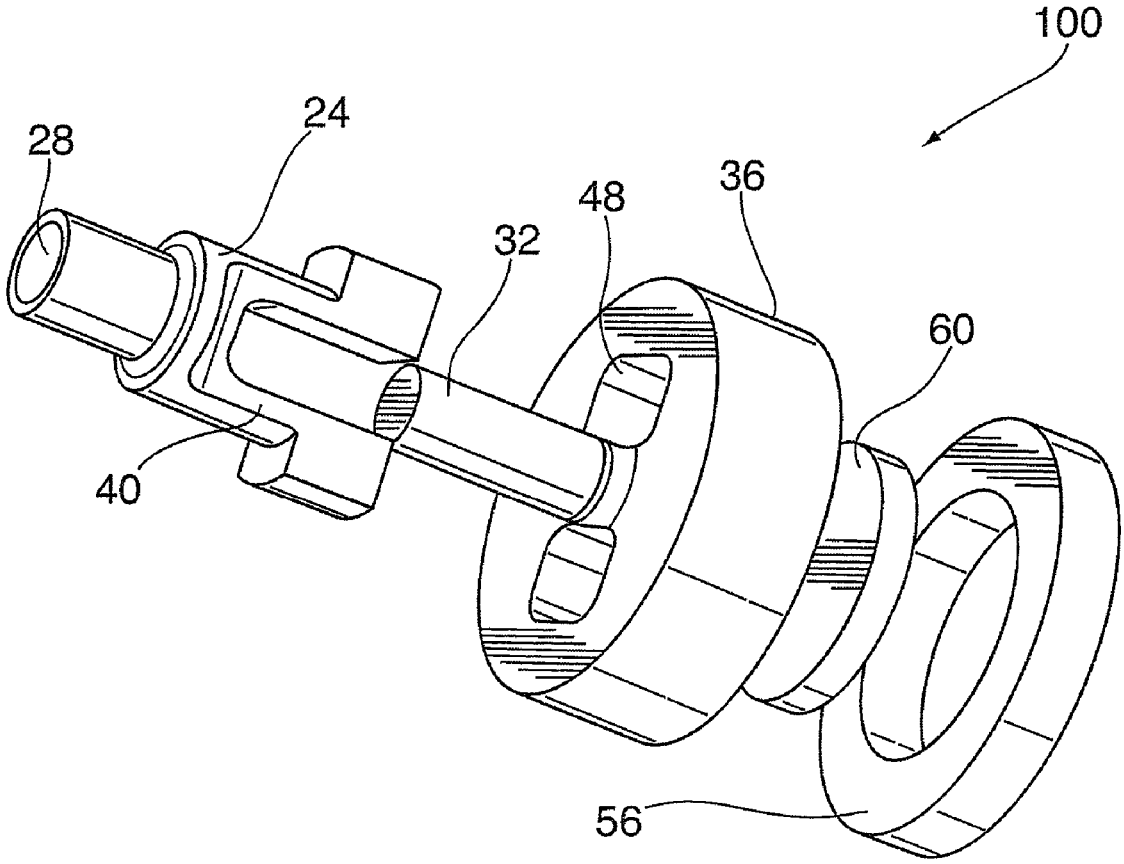
FIG. 5 shows an exploded perspective view of another embodiment of a piercing device in accordance with the present invention.

FIG. 5 shows another embodiment of a piercing device 100 in accordance with the present invention and wherein like components to those of device 20 are indicated with like reference numerals. In this embodiment, a circular aperture is to be formed with device 100 and the cutting portion of punch 24 is circular, as is guide bore 28 and support post 32. Further, in this embodiment, drive member 40 is integrally formed with punch 24.

The present invention is not limited to the particular configurations of devices 20 and 100 and it is contemplated that a variety of other configurations, as may be preferred and/or employed for various specific circumstances occur to those of skill.

As should now be apparent, the present invention provides a piercing device and method which can be used to form apertures in formed members. In particular, it is believed that the present invention is particularly suited for forming apertures in hydro-formed members. The piercing device of the present invention advantageously occupies relatively little volume, allowing multiple piercing devices to be located within relatively small volumes about a hydro-forming die, or the like. The device and method can be used to perform complete pierces, wherein the slug is removed from the formed member, or to perform partial pierces, wherein the slug is maintained captive in place until removed by a subsequent manufacturing operation. The present invention also provides for a negative pierce to be achieved, during the hydro-forming process, prior to the pierce operation being performed. This negative pierce results in a reduction in the force required to perform the pierce operation and thus permits the use of a smaller hydraulic ram, or the like. In turn, this can result in a cost saving and can result in even denser mounting of adjacent piercing devices within a hydro-forming die or the like.

The above-described embodiments of the invention are intended to be examples of the present invention and alterations and modifications may be effected thereto, by those of skill in the art, without departing from the scope of the invention which is defined solely by the claims appended hereto.

What is claimed is:

1. A piercing device for forming an aperture in a hollow member, comprising:

a punch having a cutting surface at one end to pierce the hollow member, a guide bore extending through the punch, and a pair of drive surfaces located at an opposite end of the punch and extending laterally from the punch;

a support member including a guide post complementary in shape to the guide bore and two drive passages positioned on both sides of the guide post, the punch being slidably received on the guide post;

a drive member operable to transfer a force between a ram and the punch, the drive member having a base and two arms forming a substantially U-shaped member, the two arms of the drive member abutting the two drive surfaces of the punch and extending through the support member via the two drive passages;

a backing plate located between the drive member and the ram; and a mounting member abutting the support member and receiving the base of the drive member and the backing plate.

2. A hydro-forming die comprising the piercing device of claim 1.

3. A piercing device for forming an aperture in a hollow member, comprising:

a punch having a cutting surface at one end to pierce the hollow member, a guide bore extending through the punch, and a drive member operable to transfer a force between a ram and the punch, the drive member located at an opposite end of the punch;

a support member including a guide post complementary in shape to the guide bore and two drive passages positioned on both sides of the guide post, the punch being slidably received on the guide post;

a backing plate located between the drive member and the ram; and a mounting member abutting the support member and receiving the drive member and the backing plate;

wherein the drive member has a base and two arms forming a substantially U-shaped member, the base of the drive member is integral with the opposite end of the punch, the two arms of the drive member abut the backing plate, and the two arms of the drive member extends through the support member via the two drive passages.

4. A hydro-forming die comprising the piercing device of claim 3.

* * * * *